US005415620A

United States Patent [19]

Chen

[11] Patent Number: 5,415,620

[45] Date of Patent: May 16, 1995

[54] BREAST AUGMENTATION APPARATUS

[76] Inventor: Chien-Wen Chen, No. 188 Hsiu Chiang Road, San Chung City, Taiwan, Prov. of China

[21] Appl. No.: 108,344

[22] Filed: Aug. 18, 1993

[51] Int. Cl.[6] ..... A61H 9/00

[52] U.S. Cl. ..... 601/14; 128/897

[58] Field of Search ..... 128/897; 606/201; 601/6, 7, 11, 14, 84, 154

[56] References Cited

U.S. PATENT DOCUMENTS

| | | | |
|---|---|---|---|
| 532,236 | 1/1895 | Hardesty | 601/14 |
| 1,222,494 | 4/1917 | Thomas | 601/14 |
| 1,472,234 | 10/1923 | Thomas | 601/14 |
| 5,099,830 | 3/1992 | Kishimoto | 128/38 |

FOREIGN PATENT DOCUMENTS

| | | | |
|---|---|---|---|
| 635433 | 4/1950 | United Kingdom | 128/897 |

*Primary Examiner*—Lee S. Cohen
*Assistant Examiner*—J. P. Lacyk

[57] ABSTRACT

A breast augmentation apparatus includes a rigid cup-like hollow body having an expanded open end for receiving therein a breast with a resilient gasket member mounted thereto for providing air tight sealing between the hollow body and the skin around the breast and an opposite closed end with an air evacuation duct formed thereon with an air hose mounted thereto for connecting to a air evacuation pump for draining out air inside the hollow body. A nipple protector in the form of a cup for receiving therein and protecting the nipple from the influence of air evacuation inside the hollow body is resiliently supported inside the hollow body by a helical spring. The nipple protector has an open end with a resilient skirt mounted thereto for receiving and covering the nipple in an air tight manner.

6 Claims, 4 Drawing Sheets

BREAST AUGMENTATION APPARATUS

FIELD OF THE INVENTION

The present invention relates generally to a breast augmentation apparatus.

BACKGROUND OF THE INVENTION

Breast augmentation devices are known, especially by women, for augmenting breasts in a non-surgery manner. The conventional breast augmentation devices comprise a cup-like hollow body, as that shown in FIG. 4 of the attached drawings, having an open end for receiving the breast to be augmented therein and an air evacuation duct for evacuating the air inside the hollow body so as to reduce the air pressure inside the hollow body and thus leading in expansion of the breast. By doing so, the breast is augmented as desired by the user. Such breast augmentation devices, however, have the disadvantage that the blood circulation through the nipple of the augmented breast is affected by the air evacuation in the hollow body and thus making the nipple become blackened and improperly expanded.

It is therefore desirable to provide a breast augmentation apparatus which has a nipple protector for protecting the nipple from the influence of the air evacuation inside the hollow body of the breast augmentation apparatus.

SUMMARY OF THE INVENTION

It is therefore the principal objective of the present invention to provide a breast augmentation apparatus having resiliently mounted therein a nipple protector in the form of a cup for receiving the nipple therein in an air tight manner to protect the nipple from the influence of air evacuation inside the breast augmentation apparatus.

It is also an objective of the present invention to provide a breast augmentation apparatus which is simple and practical in structure and has industrial and economic advantages.

To achieve the above objectives, there is provided a breast augmentation apparatus comprising a rigid cup-like hollow body having an expanded open end for receiving therein a breast with a resilient gasket member mounted thereto for providing air tight sealing between the hollow body and the skin around the breast and an opposite closed end with an air evacuation duct formed thereon with an air hose mounted thereto for connecting to a air evacuation pump for draining out air inside the hollow body. A nipple protector in the form of a cup for receiving therein and protecting the nipple from the influence of air evacuation inside the hollow body is resiliently supported inside the hollow body by a helical spring. The nipple protector has an open end with a resilient skirt mounted thereto for receiving and covering the nipple in an air tight manner.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
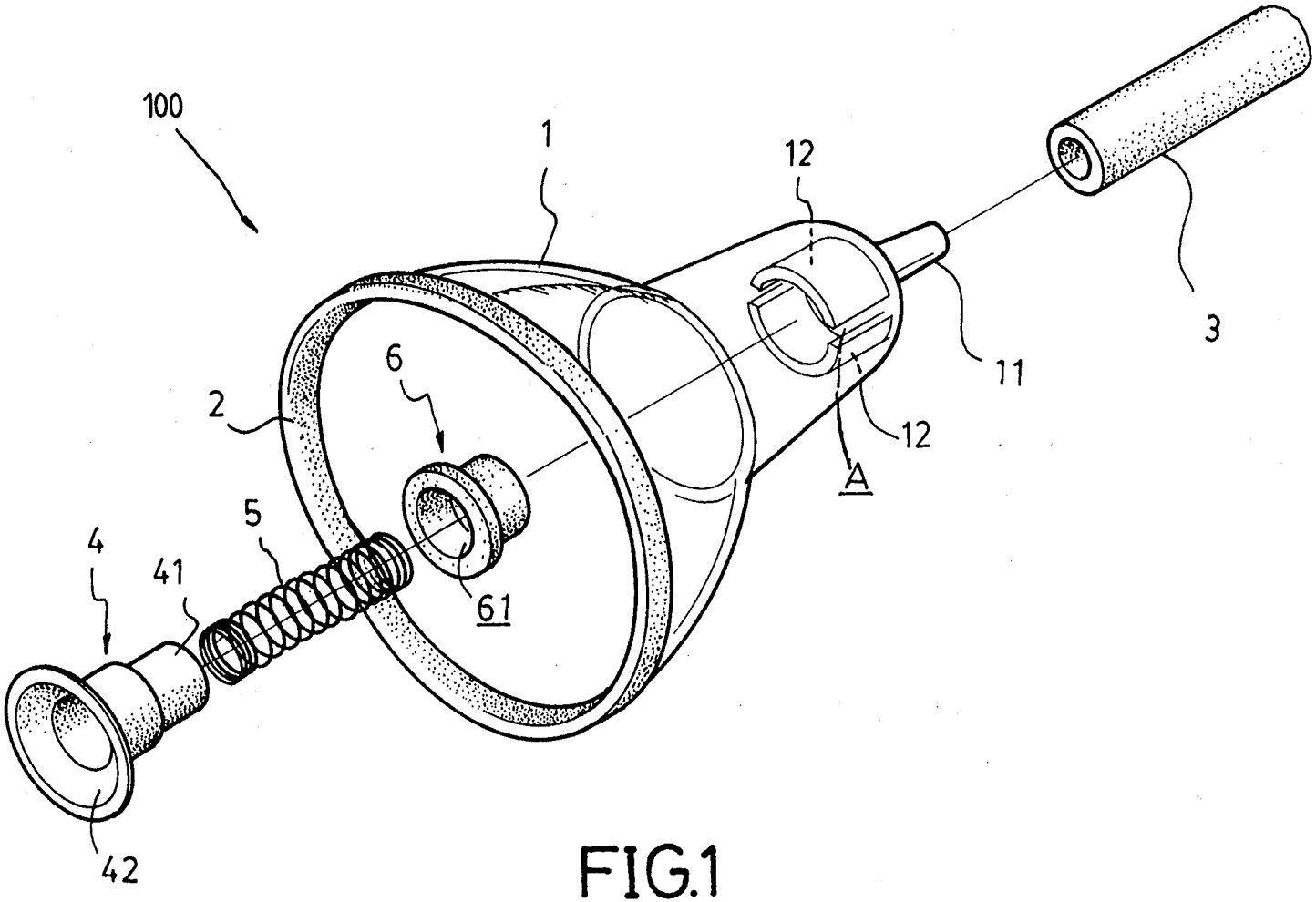
FIG. 1 is an exploded perspective view showing a breast augmentation apparatus constructed in accordance with the present invention.
Figure 2:
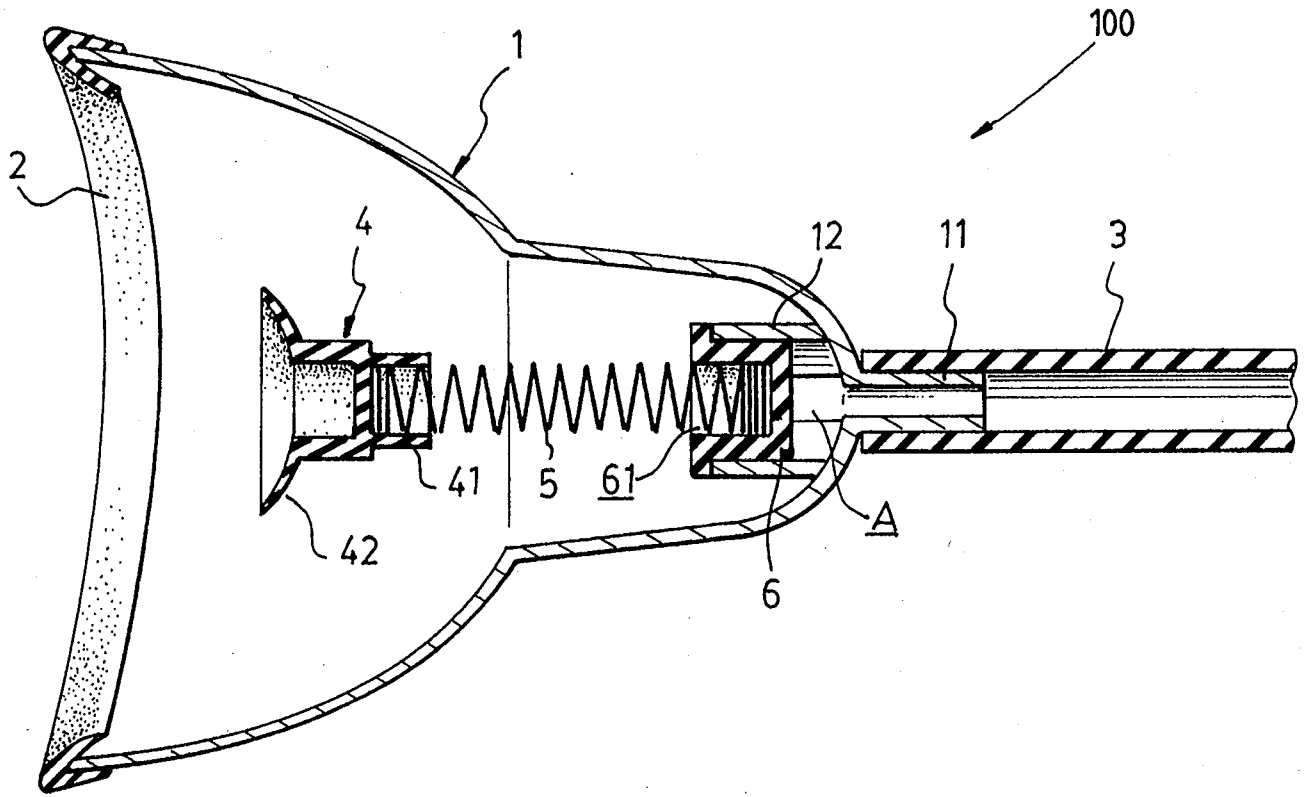
FIG. 2 is a cross-sectional view showing the breast augmentation apparatus of the present invention.

With reference to the drawings and in particular to FIGS. 1 and 2, wherein a breast augmentation apparatus constructed in accordance with the present invention, generally designated by the reference numeral 100, is shown, the breast augmentation apparatus 100 comprises a rigid funnel-like or cup-like hollow body 1 having a shape and size suitable for receiving a breast C (FIG. 3) therein. The hollow body 1 has an enlarged open end with a flexible gasket member 2 attached thereto and an opposite, closed end on which an air evacuation duct 11 is formed to provide fluid communication between inside and outside of the hollow body 1.

Figure 3:
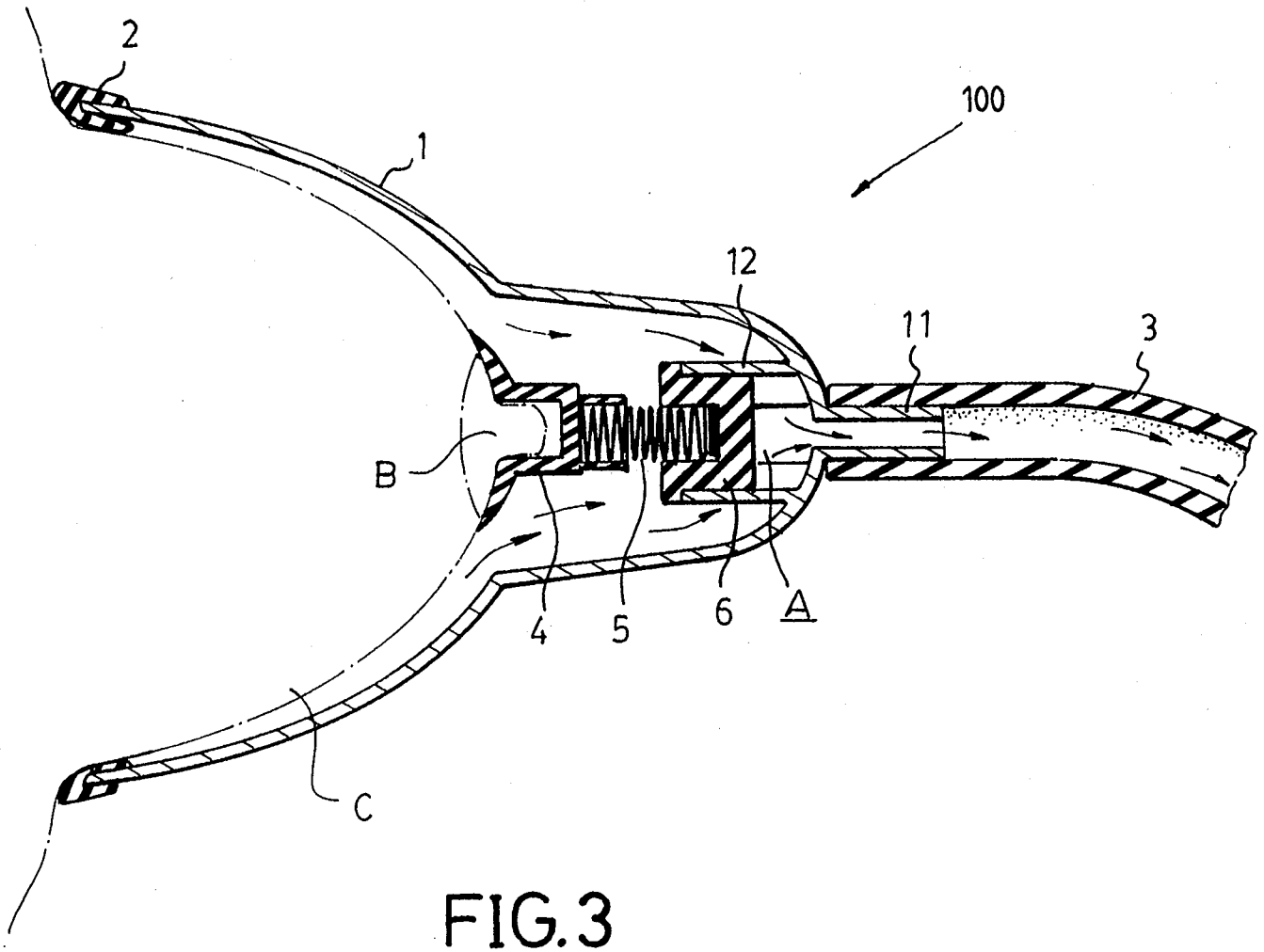
FIG. 3 is a cross-sectional view, similar to FIG. 2, showing the operation of the breast augmentation apparatus of the present invention.
Figure 4:
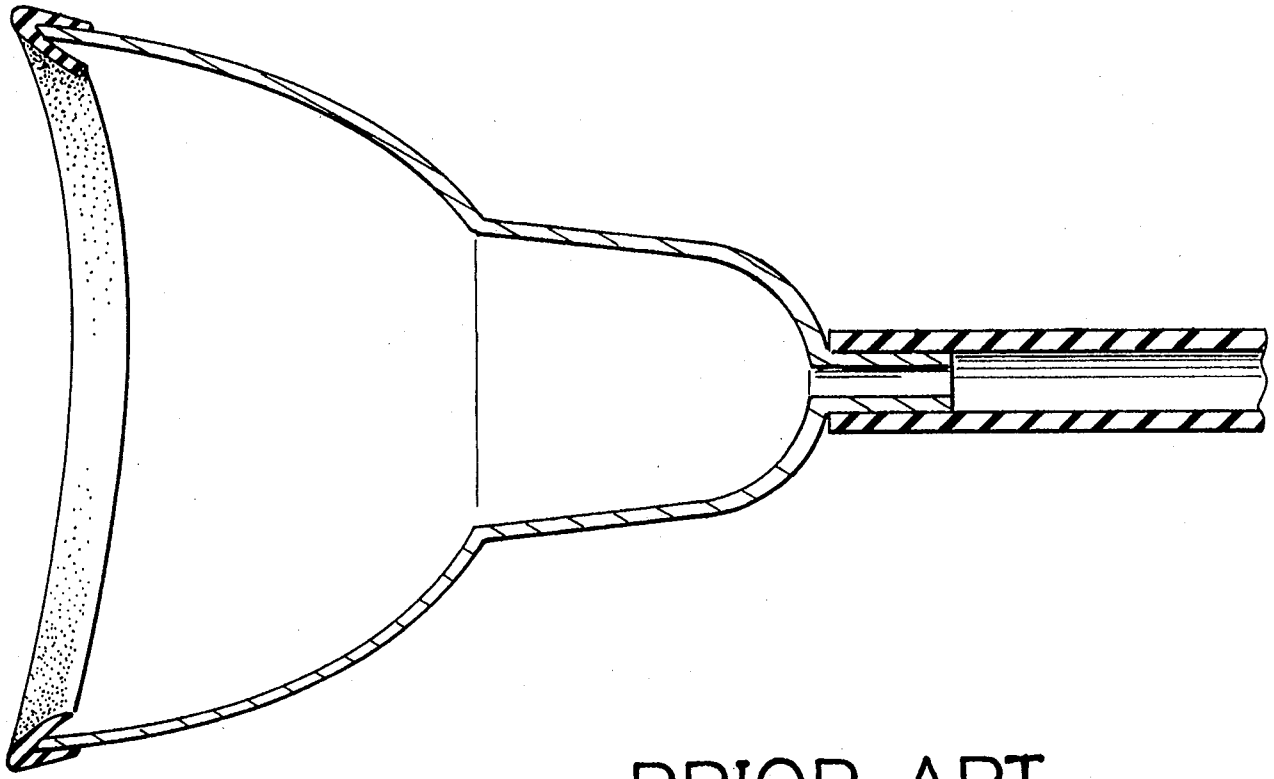
PRIOR ART FIG.4
FIG. 4 is a cross-sectional view showing a prior art breast augmentation apparatus.

A flexible tubular member 3, such as an air hose, is connected to the air evacuation duct 11 of the hollow body 1 for connecting the breast augmentation apparatus 100 to air evacuation means (not shown), such as a power pump or manually-operating pump, for evacuating the air inside the hollow body 1, as shown in FIG. 3, to carry out breast augmentation operation in accordance with the present invention.

As shown in the drawings, the breast augmentation apparatus 100 further comprises a nipple protector 4 in the form of a cup suitable for receiving a nipple B (FIG. 3) therein when the breast augmentation apparatus 100 is in use. The nipple protector 4 has an open end with a flexible compliant skirt 42 mounted thereto for completely receiving and covering the nipple B in an air tight manner as shown in FIG. 3 by having the skirt 42 compliantly contact the skin of the breast C around the nipple B.

For safely protecting the nipple B, the nipple protector 4 is resiliently supported inside the hollow body 1 by spring means 5, such as a helical spring. As shown, the helical spring 5 is received at a first end thereof within recessed holding means 41 formed on the nipple protector 4 and is fixed at a second end thereof to a retaining hole 61 formed on a holding seat 6 secured inside the hollow body 1. The holding seat 6 is supported by a plurality of segmented support legs 12, preferably two, surrounding around the air evacuation duct 11 formed on the closed end of the hollow body 1. Air passageways A are formed between the support legs 12 to allow air the pass therethrough for evacuating through the air evacuation duct 11.

In operation, as shown in FIG. 3, the user places the breast augmentation apparatus 100 on the breast C with the flexible gasket member 2 compliantly contact the skin around the breast C to prevent air from leaking into the breast argument apparatus 100 during operation. The nipple B is completely received within the nipple protector 4 through the open end thereof and air tightly sealed by the skirt 42. The use may then use the pump means (not shown) connected to the air hose 3 to evacuate the air inside the hollow body 1 of the breast augmentation apparatus 100. By evacuating the air inside the hollow body 1, the breast C expands. This provides a larger breast as desired by the user.

With the nipple protector 4 covering and protecting the nipple B by the air tight skirt 42 thereof, the air inside the nipple protector 4 is not evacuated and the air pressure inside the nipple 4 is substantially maintained so that no damage and/or influence to the blood circulation through the nipple B may occur.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A breast augmentation apparatus comprising:

a rigid cup-like hollow body having an expanded open end adapted to receive therein a user's breast to be augmented, and an opposing, closed end with an air evacuation duct formed thereon to provide communication between an inside and an outside of said hollow body, a resilient gasket member attached to the open end of said hollow body adapted to provide an air tight seal between the hollow body and the skin around the user's breast, a flexible tubular member mounted to said air evacuation duct adapted to connect said hollow body to a pumping means, the pumping means being used to evacuate air from the interior of said hollow body, and a nipple protector in the form of a cup within said hollow body and means for supporting said cup to receive therein a nipple of the user's breast in an air tight manner to keep the nipple from being influenced by the evacuation of the air inside the hollow body.

2. An apparatus as claimed in claim 1 wherein:

said nipple protector comprises an open end surrounded by a resilient skirt to receive and cover the nipple in an air tight manner, the skirt being adapted to compliantly contact the skin of the user's breast around the nipple.

3. An apparatus as claimed in claim 1 wherein: said means for supporting comprises spring means for resiliently supporting said nipple protector inside the hollow body.

4. An apparatus as claimed in claim 3 wherein:

said spring means comprises a helical spring with a first end thereof mounted to said nipple protector and a second end thereof connected to said hollow body.

5. An apparatus as claimed in claim 4 wherein:

the first end of said helical spring is received within a recess formed on said nipple protector and the second end of said helical spring is retained within a recessed seat supported by a plurality of support legs mounted to said hollow body.

6. An apparatus as claimed in claim 5 wherein:

said recessed spring seat is supported by two support legs disposed around said air evacuation duct with air passageways formed between the support legs in communication with said air evacuation duct.

* * * * *